United States Patent [19]

Perazzi

[11] Patent Number: 4,667,429

[45] Date of Patent: May 26, 1987

[54] ADJUSTABLE TRIGGER MEANS FOR RIFLES AND THE LIKE

[75] Inventor: Daniele Perazzi, Botticino, Italy

[73] Assignee: Manifattura Armi Perazzi S.p.A., Italy

[21] Appl. No.: 739,610

[22] Filed: May 30, 1985

[30] Foreign Application Priority Data

Feb. 14, 1985 [IT] Italy ..... 5116 A/85

[51] Int. Cl.[4] ..... F41C 19/00

[52] U.S. Cl. ..... 42/69.01

[58] Field of Search ..... 42/69 R, 1 R, 73; 24/241 PS, 241 SL, 580, 652; 292/150, 153; 30/320

[56] References Cited

U.S. PATENT DOCUMENTS

| | | | |
|---|---|---|---|
| 167,285 | 8/1875 | Watkeys | 42/69 R |
| 669,871 | 3/1901 | Zoeller | 42/73 |
| 2,870,537 | 1/1959 | Ortner | 30/320 |
| 3,899,845 | 8/1975 | Wild et al. | 42/69.01 |
| 4,445,292 | 5/1984 | Martin | 42/70 R |

FOREIGN PATENT DOCUMENTS

| | | | |
|---|---|---|---|
| 1445315 | 5/1966 | France | 42/69 R |

*Primary Examiner*—Charles T. Jordan
*Assistant Examiner*—Ted L. Parr
*Attorney, Agent, or Firm*—McGlew and Tuttle

[57] ABSTRACT

Disclosed is a trigger for rifles and similar firearms, which trigger is provided with an arresting element that permits the easy positioning of the trigger into the desired arresting notch of the trigger support provided in the body of the rifle. Three embodiments are presented of variants of the invention, in which essentially, a plurality of arresting notches are made in the trigger support, either beneath it or laterally thereto, and a spring-loaded arresting element with a manually operated tooth is forced into mating engagement with the notches for a constant contact of the two parts of the device.

1 Claim, 7 Drawing Figures

ADJUSTABLE TRIGGER MEANS FOR RIFLES AND THE LIKE

FIELD OF THE INVENTION

The present invention relates to a trigger means for rifles in general, and particularly, to adjustable trigger means for rifles and the like, wherein the position of the trigger itself may be adjusted and controlled.

BACKGROUND OF THE INVENTION

Adjustable triggers for rifles have already been proposed, wherein the position of the trigger may be adjusted by mounting the trigger on the body of the firearm, guiding it and displacing it longitudinally on and in relation to a lever-type support that controls the firing mechanism of the firearm.

According to the most common arrangement, the trigger is firmly attached to the support to its desired position by means of a blocking screw. Such an arrangement, however, has several drawbacks, among which is the inevitable, slow loosening of the fastener, with the resultant unreliable operation of the trigger, and the need of available tools for the tightening and loosening of the screw whenever it is desired to vary and regulate the position of the trigger.

BRIEF SUMMARY OF THE INVENTION

It is, therefore, an object of the present invention to overcome the disadvantages of the prior art by providing a trigger which is longitudinally displaceable and adjustable by means of a spring-actuated blocking means capable of positively arresting the trigger in any one of the selected positions of employment.

It is another object of the invention to provide a trigger for rifles and the like, which has means for adjusting its position in a simple and easy manner, without recurring to special tools and cumbersome operations.

Briefly stated, the present invention is directed to a trigger for rifles and the like, which is coupled to a lever-type support through longitudinally sliding guide means and which is characterized by the fact that it is provided with a spring-actuated blocking means which engages selectively one of several arresting notches provided on said support, so as to block in a positive manner the trigger in the desired position of employment.

According to a first embodiment of the invention, the blocking element is oscillating upon a pin and is provided with a tooth that engages from underneath the notches in the support serving the firing mechanism of the firearm.

In a second embodiment of the invention, the blocking element is instead mounted and slidable along one side of the trigger, so as to enage the desired notch on the corresponding lateral surface of the support.

According to a further embodiment of the invention, the blocking element is mounted and guided as a snap fast pin into the desired snap fast pin hole provided on the support, passing thus through an aperture provided in the trigger and having a terminal head portion engaging the selected notch on the support.

BRIEF DESCRIPTION OF THE DRAWINGS

These and other objects and advantages of the invention will become evident from the following detailed description thereof, with reference to the accompanying drawings, illustrative of the embodiments of the invention mentioned hereabove, and in which.

DETAILED DECSRIPTION OF THE INVENTION

Figure 1:
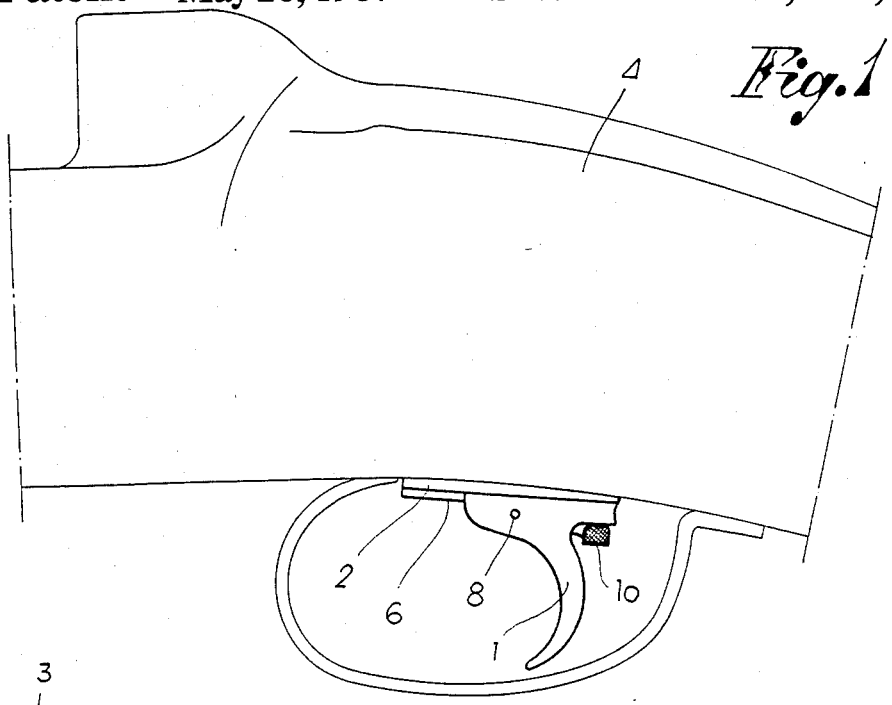
FIG. 1 represents, schematically, a trigger mounted on the body of a rifle.

Referring now to the accompanying drawings, the trigger 1 of the firearm is coupled to a lever-type support 2, so that the trigger may slide longitudinally along the support. The support 2 is pivoting at 3 and serves to control, in a manner known per se, the firing mechanism of the rifle 4, to which the trigger is attached.

The trigger 1 is provided in a horizontal upper portion 1' thereof with a guiding seat 5, dove tail shaped or T shaped or equivalently shaped, which seat serves to mate with a corresponding guide element 6 provided longitudinally on a lower surface of the support 2, so that the trigger may effect the desired displacements along and in relation with the support itself.

Figure 2:
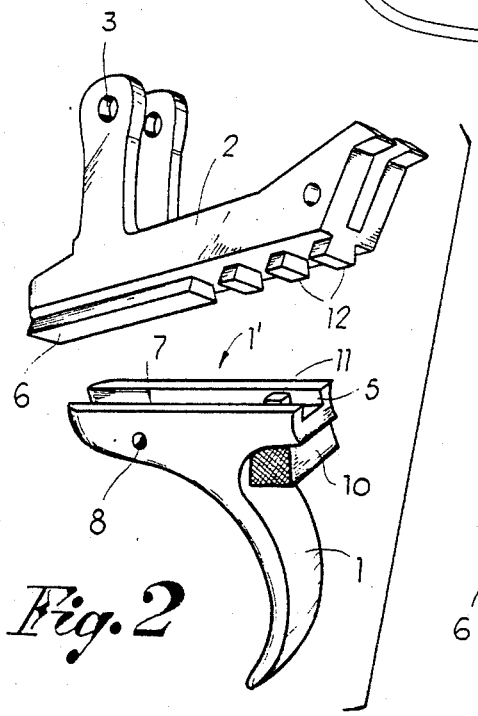
FIG. 2 is a perspective view of a first embodiment of the invention, showing the trigger and the lever support thereof separated from each other.
Figure 3:
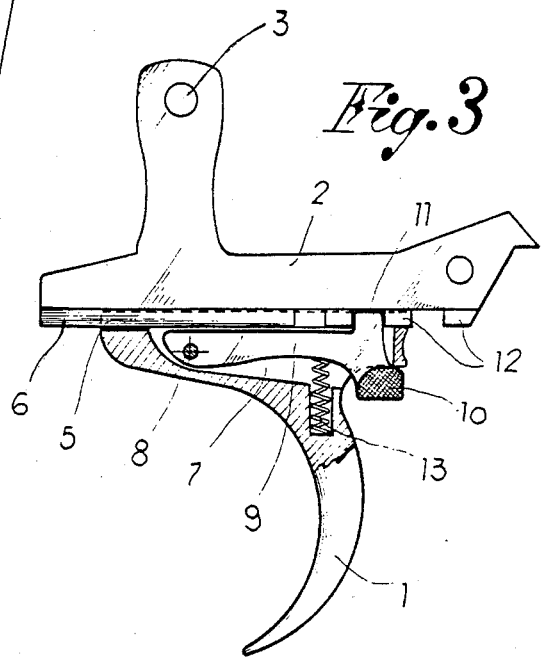
FIG. 3 is a longitudinal view of the trigger and of the support thereof shown in FIG. 2, in assembled condition.

In the first embodiment of the invention, illustrated in FIGS. 1, 2 and 3, the trigger 1 is provided with a trough 7, open in the upward direction, within which pivots, through a transverse spine 8, an oscillating element 9 having a gripping means 10 beneath the upper portion 1' of the trigger. A blocking tooth 11, facing upwardly, is provided through the seat 5 of the trigger. At the base of the support 2, that is to say along the guiding portion 6, there is provided a plurality of notches 12 for mating with arresting tooth 11. Notches 12 are spaced from one another along the longitudinal direction of the support 2, so as to mate exactly with the upwardly protruding tooth 11 of the oscillating element 9 of the trigger and, thus, define a number of different positions of employment of the trigger.

Oscillating element 9 is urged by a spring 13 in the upward direction, so that the arresting tooth 11 constantly engages one of the various notches 12 in the base of the support 2.

To vary the position of the trigger, it suffices to act on the gripping means 10 of the oscillating element 9, so as to displace the latter against the spring 13 and detach the tooth 11 from the arresting notch 12. At this point, the trigger may be moved longitudinally along the support 2 and the tooth 11 may be engaged with a new arresting notch 12, corresponding to the desired new position of employment of the trigger.

Figure 4:
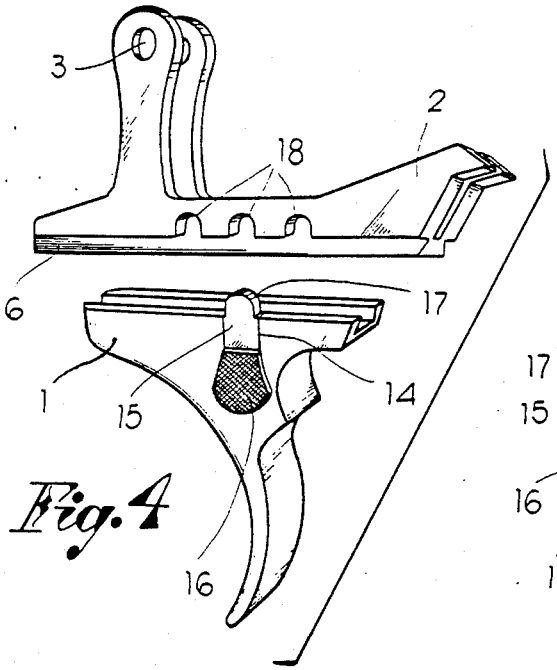
FIG. 4 is a perspective vie of a second embodiment of the invention, with the trigger and the support thereof separated from each other.
Figure 5:
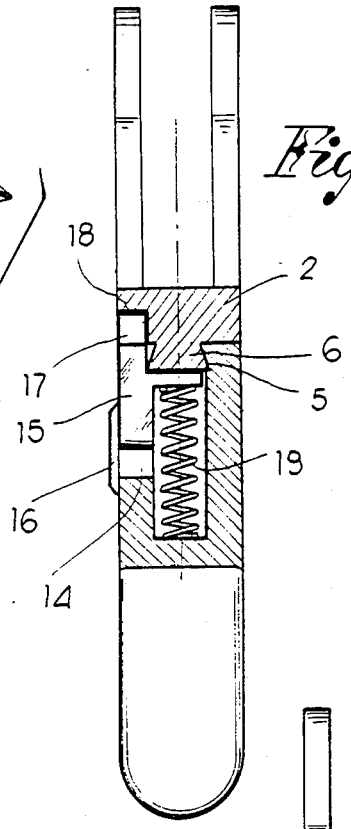
FIG. 5 is a transverse sectional view of the trigger and support thereof, shown in FIG. 4, assembled.

In a second embodiment of the invention, illustrated by FIGS. 4 and 5, on a side surface of the trigger 1 there is provided a vertical seat 14 within which is displaceably positioned a sliding element 15. Element 15 has a gripping portion 16 and an arresting tooth 17, the latter being faced upwardly so as to engage selectively the notches 18 provided on the corresponding lateral surface of the lever-type support 2.

The sliding element 15 is urged by a spring 19 which keeps the sliding element 15 normally displaced upwardly, so that the tooth 17 might constantly and positively engage the desired arresting notch 18.

Also in this case, a variation in the position of the trigger 1 is obtained by simply moving the sliding element 15 against spring 19, so as to detach the arresting tooth 17 from the notch 18 and position the trigger along the support until the tooth engages a new notch.

Figure 6:
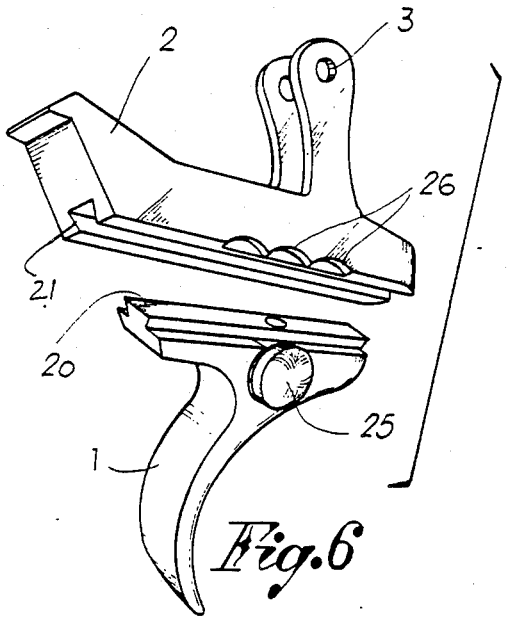
FIG. 6 is a perspective view of a third embodiment of the invention, with the trigger and the support thereof separated from each other.
Figure 7:
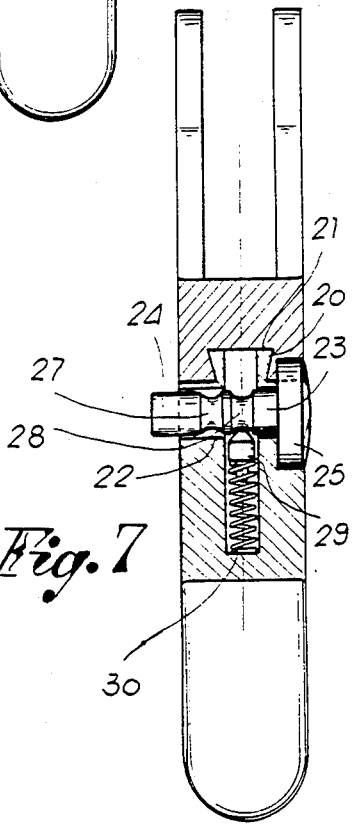
FIG. 7 is a transverse, sectional view of the trigger and support thereof, shown in FIG. 6, assembled.

In the third embodiment of the invention, illustrated by FIGS. 6 and 7, the trigger 1 is provided with an upper dovetailed surface 20, while the support 2 has a corresponding and mating channel 21, longitudinally thereof, contrary to the previously described configurations. Further, in the trigger there is a transverse opening 22 within which is displaceably positioned a snap fast pin 23 consisting of a stem 24, guided within said opening 22, and a blocking head 25, terminally positioned and shaped, for example, circularly. Head 25 serves to selectively engage the arresting notches 26 provided on a lateral surface of the support 2 and defining the various positions of employment of the trigger.

The stem 24 of the snap fast pin 23 has two peripheral throats 27–28, in which, alternately, engages a sping loaded pawl 29. The spring 30 acts on pawl 29, so as to arrest the snap fast pin in the operative or inoperative condition, respectively.

In order to change the position of the trigger, it suffices to act on the free extremity of the stem 24 to displace the snap fast pin 23 into the inoperative condition, so that the arresting head 25 is disengaged from the notches 26. The trigger may then be moved along the support 2 and blocked in the desired position by simply pushing the snap fast pin 23 in the operative condition and engage the head 25 of the pin in a lateral notch of the support.

Actually, in practice, the trigger and its support are coupled to each other in a vertical and also in a transverse direction through the sliding coupling effect and are blocked also in the longitudinal direction, in a reciprocal manner, in the desired condition through the blocking means mounted on the trigger and engaging the arresting notches of the support.

While three embodiments of the invention have been described and illustrated in the accompanying drawings, it is understood that the accompanying claims encompass also all other variants in construction which utilize the same inventive principle and are within easy grasp of the artisan's skill.

What is claimed is:

1. Adjustable trigger means for rifles and the like type firearms, comprising a trigger supporting means pivotably attached to the body of the rifle; a plurality of arresting notches longitudinally positioned in said trigger supporting means; a spring loaded arresting element in said trigger means, longitudinally displaceable along said supporting means and selectively engageable with said arresting notches; said arresting element being a snap fast pin having a stem guided through an opening transversely provided in said trigger means, a terminal head for selectively engaging with said arresting notches; said arresting notches being positioned on a side surface of said trigger supporting means and parallel to a longitudinal trough in said supporting means; said trigger having a protruding, dove-tailed upper surface for mating engagement with said trough; said snap fast pin having a pair of peripheral throats within which alternately engages a spring-loaded pawl for the engagement with and disengagement from said arresting notches of said terminal head of said snap fast pin.

* * * * *